United States Patent [19]

Sinclair

[11] 3,996,876

[45] Dec. 14, 1976

[54] MARINE LINE SECURING APPARATUS

[76] Inventor: Lawrence L. Sinclair, 123 Old Carriage Road, Ponce Inlet, Fla. 32019

[22] Filed: Nov. 10, 1975

[21] Appl. No.: 630,315

[52] U.S. Cl. ..... 114/218; 24/115 J

[51] Int. Cl.[2] ..... B63B 21/04

[58] Field of Search ..... 114/75, 218; 24/115 J, 24/129 R; 105/473; 244/115

[56] References Cited

UNITED STATES PATENTS

| | | | |
|---|---|---|---|
| 1,972,725 | 9/1934 | White | 24/129 R |
| 3,507,243 | 4/1970 | Brown | 114/218 |
| 3,574,900 | 4/1971 | Emery | 114/218 |

*Primary Examiner*—Trygve M. Blix
*Assistant Examiner*—Charles E. Frankfort
*Attorney, Agent, or Firm*—Duckworth, Hobby, Orman, Allen, & Pettis

[57] ABSTRACT

A line securing apparatus for attaching the line of a marine vessel to a dock, pier, or the like, has a base adapted with a post attached thereto. A plurality of rings is attached to the post and to each other whereby a boat line may be slipped through the rings and over the post to hold the line to the dock. A wedging member is also attached to the post for wedging a vessel line therein; and protruding rods give additional support to a line held in the wedging member.

11 Claims, 4 Drawing Figures

MARINE LINE SECURING APPARATUS

BACKGROUND OF THE INVENTION

The present invention related to line posts for securing marine vessels and especially to a line post for attachment to a dock or pier to which a vessel line can be rapidly coupled and uncoupled without the necessity of tying knots.

In the past marine vessel lines have generally been attached to posts supporting docks or piers by tying the rope to the post extending above the boardwalk. The boat itself generally has a plurality of cleats in which to attach the boat line to the boat in a manner that the line can be readily adjusted as to length. A variety of cleats for securing lines rapidly and firmly have been suggested and may be seen illustrated in U.S. Pat. No. 3,574,900 for a Jamming Cleat, U.S. Pat. No. 3,465,391 for a Sure-Hold, Non-Slip Rope Fastener, U.S. Pat. No. 3,233,934 for a Rope Anchor, U.S. Pat. No. 3,507,243 for a Marine Cleat and Rope Guide, and in U.S. Pat. No. 3,715,782 for a Device for Securing a Line. In one prior U.S. Pat. No. 3,780,690 a line-post coupling and marine mooring or towing device is provided in which a marine line may be coupled and uncoupled with a post without the necessity of tying or untying knots. This latter patent illustrates a post having a ball attached to one end of the post and a supported ring wrapped around the post under the ball so that a rope already having a loop therein can be slipped under the loop and over the ball to be supported by the post. The connecting of the rope to the post works very much like puzzles that are solved by getting a string into or out of a loop and might be confusing to a person not familiar with the system of hooking the line to the post. In addition, for large vessels, such a system would require a very heavy support for the ring to prevent it wearing or corroding and breaking.

The present invention related to a line securing post which can be rapidly attached to a dock, pier or to the top of a post for rapidly securing a line with or without a loop in the end of a line and which is simple to use and to produce.

SUMMARY OF THE INVENTION

The present invention relates to a marine line securing device for attaching a marine vessel line with or without a loop in the end of the line. The device has a base which is readily attachable to a dock, pier, boat or the like. A post is attached to the base and extends therefrom. A plurality of rings is fixably attached to the post and to each other whereby a rope with a loop may be pulled through one of the rings and dropped over the post for securing the line to the post. In addition, an arced and angled wedge member is fixably attached to the post in a manner that a line without a loop may be slipped between the wedge member and the post and wedged therebetween. The post or the wedge member may have a knurled or roughened surface for securing the rope. In addition, protruding rods allow the wedged rope to be quickly twisted thereon to add additional support to the wedged line.

BRIEF DESCRIPTION OF THE DRAWINGS

Other objects, features and advantages of the present invention will be apparent from the written description and the drawings in which.

DESCRIPTION OF THE PREFERRED EMBODIMENTS

Figure 1:
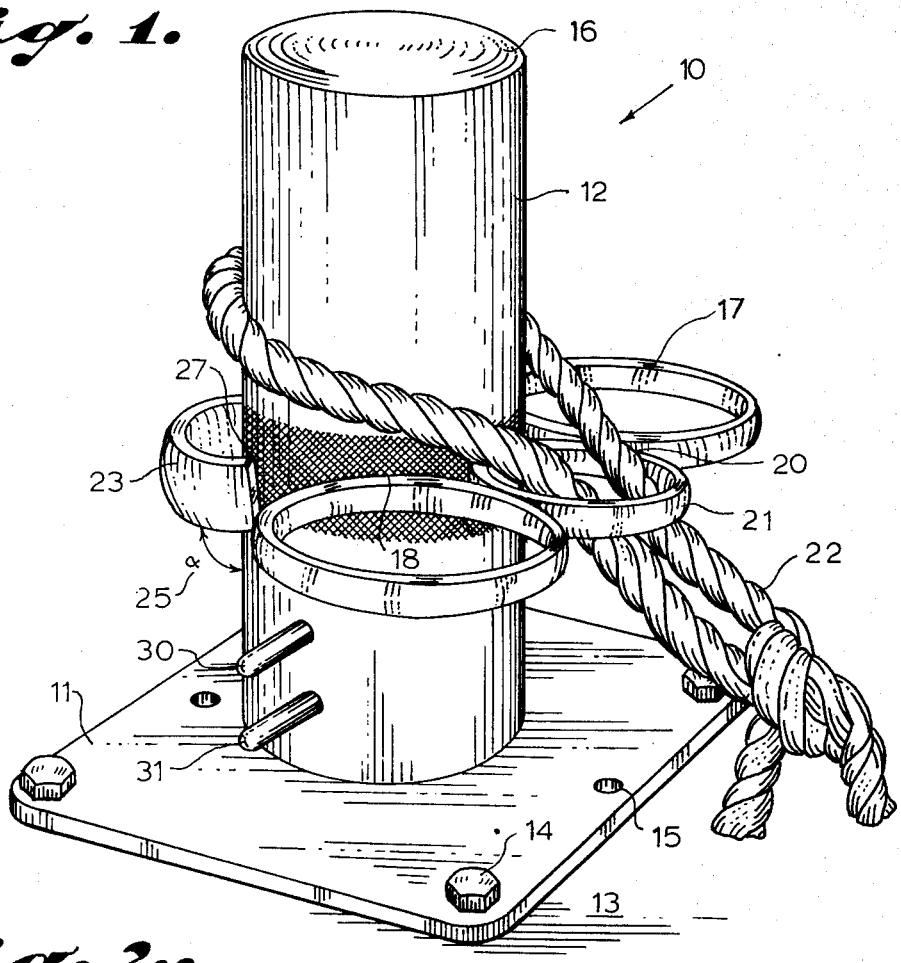
FIG. 1 is a perspective view of a preferred embodiment of the present invention having a marine line attached thereto.
Figure 2:
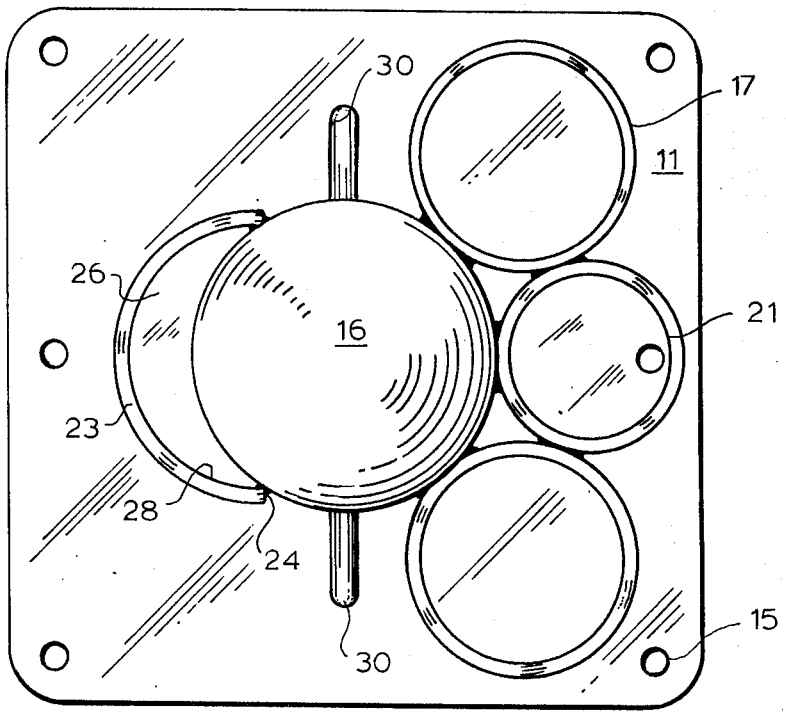
FIG. 2 is a top plan view of the embodiment of FIG. 1.
Figure 3:
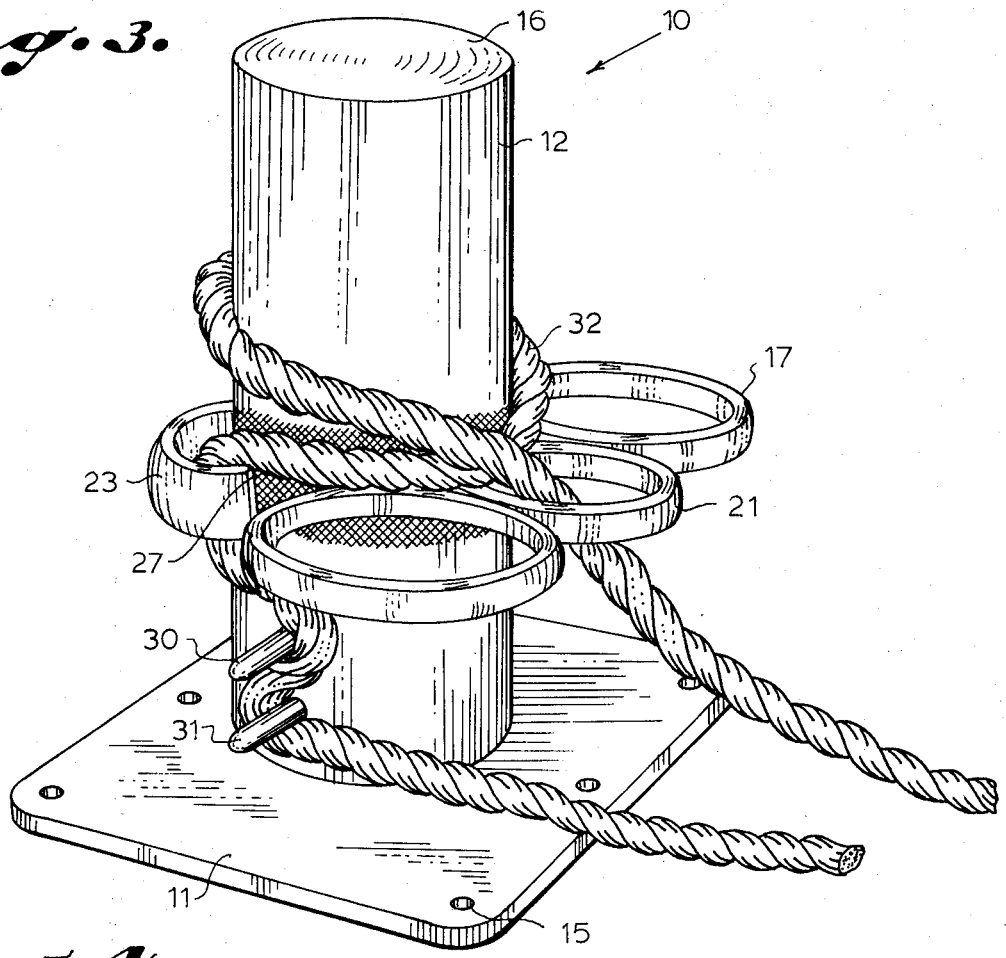
FIG. 3 is a perspective view of the embodiments in FIGS. 1 and 2 having a marine line without a loop attached thereto.
Figure 4:
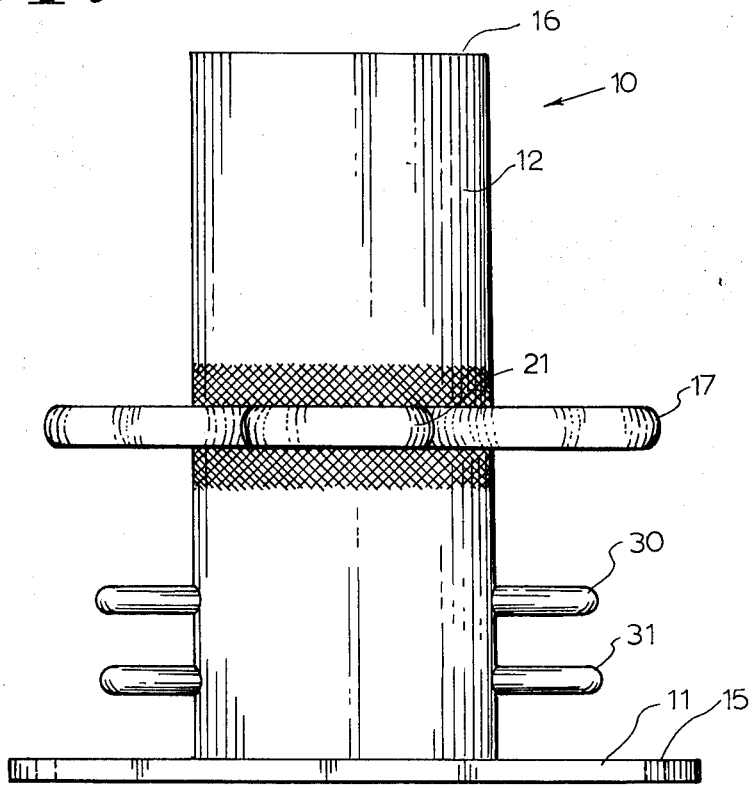
FIG. 4 is a front side elevation of the embodiments of FIGS. 1 through 3.

Referring now to FIGS. 1 through 4 of the drawings a marine line securing device 10 is illustrated having a base 11 and a vertically extending post 12. The base 11 has rounded corners and is attached to a dock or pier surface 13 by means of bolts 14 passing through openings 15 in the base 11. The base 11 is rigidly attached to the post 12, such as by welding or by any means desired and supports the post 12 in an upright position. It should be noted, however, that base 11 could be enlarged cylindrical design for slipping over a dock post for attachment to the post without departing from the spirit and scope of the invention. Post 12 may be capped with a top 16 which may be formed as an integral part of the post 12 to prevent water from entering and accumulating in the post 12 and to avoid the sharp edges of an open metal post. Post 12 has a plurality of rings 17 attached, such as by welding, at 18 to the post 12 and by welding to each other. One ring 21 is smaller than the other two but it should be clear that the rings 17 can be, but need not be, of uniform size. The rings 17 have top and bottom rounded edges and allows a marine line 22 having a loop in the end thereof to be inserted through one of the rings 17 and over the post 12 to secure the marine line 22 thereto in a rapid and efficient manner for preventing the marine line 22 from jumping off of the post 12. The post 12 also has an arc shaped wedge member 23 attached by a weld to the post 12 forming a wedge angle 25 slanting from the horizontal approximately 5 degrees which allows different size ropes to be inserted in the opening 26 formed between the wedge member 23 and the post 12 and then wedged thereinto against a knurled surface 27. The inside surface 28 may be splined or otherwise roughened to engage the marine line. To prevent the loose end of a marine line from dangling and working its way free of the wedged grip a pair of rods 30 and 31 having rounded tips are attached to either side of the post 12 and protrude horizontally therefrom and allow the line 32, not having a loop in the end thereof, to be rapidly pulled through one of the rings 17 wrapped around the post 12 and wedged between the wedge member 23 and the post 12 and then wrapped around rod 30 and back around rod 31, thereby firmly securing the marine line to the post 12 as illustrated in FIG. 3.

It will be clear to those skilled in the art that the line securing device 10 is designed to allow marine lines to be hooked thereto in a great variety of ways other than those illustrated. It should also be clear that the line securing device 10 can be made of a great variety of materials as desired. It is anticipated that steel can be used for its strength, then coated for resistance to corrosion, but it should also be clear that aluminum alloys or even strong plastics, especially if reinforced, can be utilized without departing from the spirit and scope of the invention. The present line securing device can also be attached to boats for securing lines thereto or to construction equipment or any place where a rope, cable or line needs to be quickly connected and disconnected in a manner to prevent it slipping loose. Accordingly, the present invention is not to be construed as being limited to the forms illustrated which are to be considered as illustrative rather than restrictive.

I claim:

1. A line securing apparatus comprising in combination:

a base;

a post attached to said base;

at least one ring attached to said post whereby a line can be passed through said ring and looped over said post; and wedge means attached to said post for wedging a line between said wedge means and said post for locking a line therein, said wedge means having an arc shaped member attached to said post at a slight angle to a perpendicular plane through said post for engaging a line, whereby lines may be connected to said line securing apparatus.

2. The apparatus in accordance with claim 1 in which said post has a knurled surface below said wedge means for gripping a line wedged therein.

3. The apparatus in accordance with claim 2 in which said wedge means arc shaped member has a splined surface on the inside thereof for engaging a line thereto between said wedging member and said post.

4. The apparatus in accordance with claim 3 in which said arc shaped member forms an angle to a perpendicular plane with said post of approximately 5°.

5. The apparatus in accordance with claim 4 in which a plurality of rods are fixedly attached to said post and protrude therefrom for wrapping a marine line being held in said wedge means.

6. The apparatus in accordance with claim 5 in which two said rods are attached to two sides of said post and have rounded tips.

7. The apparatus in accordance with claim 1 in which said base is a flanged base plate having rounded corners and a plurality of openings therein for attaching said base plate to a dock, pier, or the like.

8. The line securing apparatus comprising in combination;

a base;

a post attached to said base;

a plurality of rings attached to said post whereby a line can be passed through a ring and looped over said post, said plurality of rings being attached to one side of said post and extending radially from said post; and wedge means attached to the opposite side of said post from the plurality of rings for wedging a line between said wedge means and said post for locking a line therein whereby lines may be connected to said line securing apparatus.

9. The apparatus in accordance with claim 8 in which said plurality of rings is three rings each having rounded edges.

10. The apparatus in accordance with claim 9 in which said rings are attached to said post and to each other for additional support.

11. The apparatus in accordance with claim 10 in which said plurality of rings are cylindrical in shape and have rounded edges.

* * * * *